US006244526B1

(12) United States Patent
Schuldt et al.

(10) Patent No.: US 6,244,526 B1
(45) Date of Patent: Jun. 12, 2001

(54) FUEL INJECTION VALVE

(75) Inventors: Dietrich Schuldt, Korntal-Münchingen; Ferdinand Reiter, Markgröningen; Martin Mueller, Möglingen; Bo Yuan, Karlsruhe; Andreas Eichendorf, Schorndorf; Christiane Glumann, Stuttgart; Thomas Sebastian, Ditzingen-Heimerdingen; Gerhard Stokmaier, Markgröningen; Rainer Norgauer, Ludwigsburg; Christian Preussner, Markgröningen; Rainer Schneider, Oberriexingen; Norbert Keim, Löchgau; Ottmar Martin, Hochdorf/Eberdingen, all of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/077,170

(22) PCT Filed: Sep. 24, 1997

(86) PCT No.: PCT/DE97/02160

§ 371 Date: May 21, 1998

§ 102(e) Date: May 21, 1998

(87) PCT Pub. No.: WO98/13837

PCT Pub. Date: Apr. 2, 1998

(30) Foreign Application Priority Data

Sep. 24, 1996 (DE) ..... 196 39 117

(51) Int. Cl.[7] ..... F02M 51/00
(52) U.S. Cl. ..... 239/585.1
(58) Field of Search ..... 239/585.1–585.5, 239/900; 251/129.21

(56) References Cited

U.S. PATENT DOCUMENTS 4,262,877 * 4/1981 Lang ..... 251/141
4,875,658 * 10/1989 Asai ..... 239/585.5
4,958,771 9/1990 Klomp ..... 239/453
4,984,549 * 1/1991 Mesenich ..... 239/585.5
5,247,918 9/1993 Wakeman ..... 123/470

FOREIGN PATENT DOCUMENTS 30 16 993 11/1980 (DE) .
32 30 844 2/1984 (DE) .
37 33 809 4/1988 (DE) .
40 03 227 1/1991 (DE) .
195 03 821 8/1996 (DE) .
196 01 019 7/1997 (DE) .

* cited by examiner

*Primary Examiner*—David A. Scherbel
*Assistant Examiner*—Christopher S. Kim
(74) *Attorney, Agent, or Firm*—Kenyon & Kenyon

(57) ABSTRACT

A fuel injection valve for fuel injection systems of internal combustion engines includes a core which serves as the internal pole is made of a soft magnetic powder composite material. This powder composite material is an iron powder provided with a polymer additive, where the individual iron particles are coated with an electrically insulating layer. Such a powder composite material ensures a substantial minimization of eddy currents in the magnetic circuit in comparison with materials known previously, such as chromium steel, which are usually used as magnetic materials. The core which is mechanically sensitive and is sensitive to fuel is encapsulated at least with respect to the parts of the injection valve carrying the fuel. A sleeve passes through an internal longitudinal opening in the core which permits fuel flow in its interior and is fixedly attached to a pole part which seals the core toward the bottom. The core and the magnetic coil are thus not exposed to any wetting by fuel. This fuel injection valve is especially suitable for use in fuel injection systems of internal combustion engines with mixture compression and external ignition.

30 Claims, 6 Drawing Sheets

FUEL INJECTION VALVE

BACKGROUND OF THE INVENTION

The invention relates to a fuel injection valve according to the definition of the species of claim 1 and claim 2.

Fuel injection valves are already known that can be operated electromagnetically and thus have a magnetic circuit comprising at least a magnet coil, a core an armature and a stationary pole. Such fuel injection valves are presented and described, for example, in such publications as German DE-OS 30 16 993, DE-PS 32 30 844, DE-PS 37 33 809, DE-PS 40 03 227 and DE-OS 195 03 821. Ferromagnetic (magnetically soft) materials are usually used for the solid core with a compact one-piece design (and for the movable armature). Ferritic chromium steel, a 13% chromium steel, for example, has proven to be an especially suitable material for cores in fuel injection valves. Such a ferritic chromium steel is a good compromise, because although it has somewhat less favorable magnetic properties in comparison with ferritic soft iron, for example, it is very suitable for use in a compact and highly structured fuel injection valve due to its good machinability and handling. If there is a change in magnetic flux density in the core carrying a magnetic flux due to the electric current flowing in the magnet coil, stresses are induced in the flux field perpendicular to the direction of flux, resulting in eddy currents. These eddy currents weaken the effective magnetic field, because they create an opposing field. The result is a magnetic circuit with a reduced efficacy which is to be improved according to this invention.

ADVANTAGES OF THE INVENTION

The fuel injection valve according to this invention with the characterizing features of claim 1 and claim 2 has the advantage that a magnetic circuit that minimizes eddy currents is created by simple and inexpensive use of materials having a lower eddy current tendency for the core. The execution of selected partial volumes of the internal pole of the magnetic circuit, in particular the core, with a material having a low tendency to eddy currents yields an advantageous shortening of switching times (pickup time, closing time) of the valve in comparison with known magnetic circuits having the same geometry, and does so without any mentionable reduction in the maximum force level of the magnetic circuit. The shortening of switching time in comparison with comparable known injection valves amounts to 15% to 50%. Magnetically soft powder composite materials have proven especially advantageous as low-eddy-current materials.

It is also advantageous to manufacture part of the core forming the magnetic circuit from a pure ferritic material, with the core being composed of several sectors forming an annulus and the individual sectors electrically insulated from one another. Such a design of the core also has a lower tendency to eddy currents than known compact cores of ferritic chromium steel, so that even in this case, the switching time of the valve is shortened while the quality of the magnetic properties is the same.

According to this invention, the switching times are shortened and thus the linearity of the fuel injection valve is improved without any sacrifices in terms of the magnetic force at the same time. Furthermore, utilization of power is improved, which thus yields lower heating of the magnet coil and the possibility of utilizing the magnetic circuit energy in shutdown for the next energizing phase. This in turn makes it possible to implement a simple and inexpensive layout of the output stage to be driven.

Encapsulation of the low-eddy-current material, which is mechanically more susceptible and is not necessarily completely resistant to fuel (especially when gasoline is the fuel) prevents contamination problems with the fuel injection valves and guarantees the required functional reliability and endurance. The means for encapsulation of the core ensure that there is a tight seal to the fuel flow path and thus wetting by the fuel is ruled out.

Through the measures characterized in the subclaims, advantageous refinements and improvements of the fuel injection valve characterized in claim 1 and claim 2 are possible.

It is especially advantageous to use as the powder composite material an iron powder containing a polymer additive, where the individual particles of iron are coated with electrically insulating layers (phosphate layers). Due to the high electric resistance between the powder particles, hardly any eddy currents can develop there. Although phosphating the particles of iron ensures insulation of the particles, the polymer additive serves both to insulate the particles and to bind the individual particles together. This material structure permits the above-mentioned low-eddy-current effect and the resulting very good switching dynamics of the injection valve.

A sleeve which extends through a longitudinal opening in the core and encapsulates it toward the inside is designed in an advantageous manner of a very thin wall of stainless austenitic steel (e.g., V2A steel) which is largely free of magnetic flux and eddy currents. The efficacy of the magnetic circuit is affected only very slightly by the thin-walled nonmagnetic sleeve, so that the positive magnetic properties of the low-eddy-current materials are definitely predominant. The core is encapsulated on its lower end face with an adjacent pole part made of a ferritic material. It is advantageous if both the sleeve and the pole part are designed as thin as possible, with the sleeve being made of a material having a higher magnetic resistance than the core and also having a higher magnetic resistance than the pole part.

DRAWING

Embodiments of the invention are illustrated in simplified form in the drawing and explained in detail in the following description.

DESCRIPTION OF THE EMBODIMENTS

Figure 1:
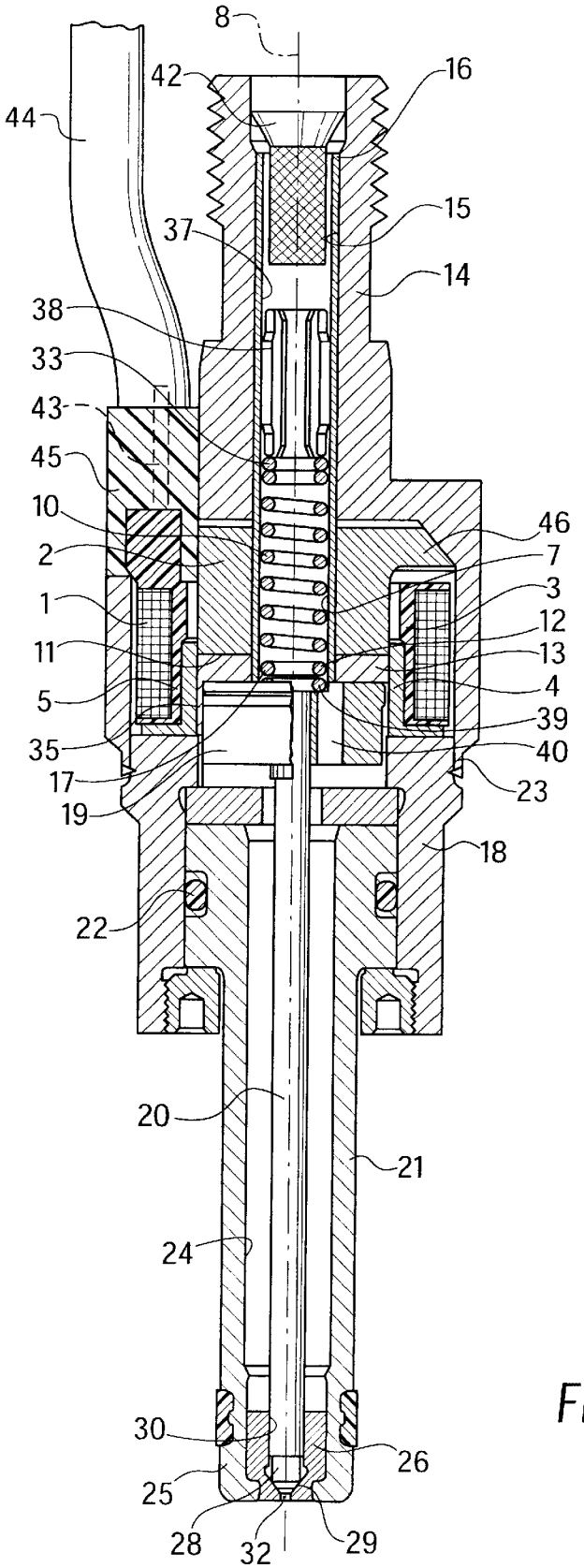
FIG. 1 shows one embodiment of a fuel injection valve with a magnetic circuit according to this invention.

The electromagnetically operable valve, shown as an example of a first embodiment in FIG. 1 in the form of an injection valve for fuel injection systems of internal combustion engines with mixture compression and external ignition has a tubular, mostly hollow cylindrical core 2 designed according to this invention to serve as the internal pole of a magnetic circuit, surrounded at least partially by a magnet coil 1. This fuel injection valve is especially suitable for direct injection of fuel into a combustion chamber of a combustion engine. A stepped coil body 3, for example, accommodates a winding of magnet coil 1 and permits an especially compact and short design of the injection valve in the area of magnet coil 1 in combination with core 2 and an annular non-magnetic connecting piece 4 with an L-shaped cross section, which is partially surrounded by magnet coil 1. One leg of connecting piece 4 projects in the axial direction into a step 5 of bobbin 3 and the other leg extends radially along an end face of bobbin 3, which is at the bottom in the figure. According to this invention, core 2 is made of a powder composite material whose properties are to be explained in detail later. A longitudinal through opening 7 is provided in core 2 and extends along a longitudinal valve axis 8. Likewise, a thin-walled tubular sleeve 10 which projects through the inside longitudinal opening 7 in core 2 and is inserted at least to a lower end face 11 of core 2 in the downstream direction also runs concentric with longitudinal valve axis 8. Sleeve 10 is in direct contact with the wall of longitudinal opening 7 or with a gap between them, and it has a sealing function with respect to core 2. A ferritic pole part 13 in the form of a ring disk which is in contact with the lower end face 11 of core 2 and borders core 2 in the downstream direction is fixedly and tightly connected to nonmagnetic sleeve 10, which is made of stainless austenitic CrNi steel, for example, referred-to briefly as V2A steel. Sleeve 10 and pole part 13, which is designed as a pressed part, for example, and is attached to sleeve 10 by welding or soldering, form an encapsulation of core 2 in the downstream direction, effectively preventing direct contact of the fuel with core 2. Sleeve 10 projects with its downstream end to a shoulder 17 of an internal through-hole 12 in pole part 13 and is connected to this shoulder 17, for example. Together with connecting piece 4, which is also attached fixedly and tightly, e.g., by welding or hard soldering, to the leg of pole part 13 running in the axial direction, this encapsulation also ensures that magnet coil 1 remains completely dry while fuel flows through it and thus it is not wetted by fuel.

Sleeve 10 also serves as the fuel supply channel, forming a fuel inlet connection together with an upper metallic (e.g., ferritic) housing part 14 which largely surrounds sleeve 10. A through-hole 15 having, for example, the same diameter as longitudinal opening 7 in core 2 is provided in housing part 14. Sleeve 10 which projects through housing part 14, core 2 and pole part 13 in the respective openings 7, 12 and 15 is also tightly and fixedly attached to housing part 14, e.g., by welding or by a flange border at the upper edge 16 of sleeve 10 in addition to the fixed connection to pole part 13. Housing part 14 forms the inlet end of the fuel injection valve and surrounds sleeve 10, core 2 and magnet coil 1 at least partially in the axial and radial directions and extends beyond magnet coil 1, e.g., downstream as seen in the axial direction. A bottom housing part 18 is connected to top housing part 14 and surrounds an axially movable valve part comprising an armature 19 and a valve needle 20, and accommodates a valve seat carrier 21. The two housing parts 14 and 18 are fixedly attached to one another, e.g., by a peripheral weld, in the area of the lower end 23 of top housing part 14.

In the embodiment illustrated in FIG. 1, the bottom housing part 18 and the largely tubular valve seat carrier 21 are fixedly attached to one another by means of a screw connection; however, welding and soldering are other equally possible joining methods. The seal between housing part 18 and valve seat carrier 21 is accomplished, for example, by means of a gasket 22. Valve seat carrier 21 has an internal through-hole 24 which is concentric with longitudinal valve axis 8 over its entire axial length. With its lower end 25, which is also the downstream end of the entire fuel injection valve, valve seat carrier 21 surrounds a valve seat body 26 which is fitted into through-hole 24. Valve needle 20, which is bar-shaped, for example, and has a circular cross section, is arranged in through-hole 24 and has a valve closing section 28 on its downstream end. This valve closing section 28 has a conical taper and works in a known way with a valve seat face 29 which has a truncated conical taper, for example, in the direction of flow and is provided in valve seat body 26, said valve seat face being designed downstream in the axial direction of a guide opening 30 in valve seat body 26. At least one, but also two or four outlet openings 32 for fuel is (are) provided in valve seat body 26 downstream from valve seat face 29. Flow areas (recesses, grooves, etc.; not shown here) are provided in guide opening 30 and in valve needle 20, ensuring unhindered flow of fuel from through-hole 24 to valve seat face 29.

The arrangement shown in FIG. 1 of bottom housing part 18, valve seat carrier 21 and the movable valve part (armature 19, valve needle 20) is only one possible design variant of the valve assembly downstream from the magnetic circuit. This valve area is omitted in all the following figures, and it should be pointed out that a wide variety of different valve assemblies can be combined with the design of core 2 according to this invention. In addition to injection valves which open toward the interior (e.g., U.S. Pat. No. 5,247,918), valve assemblies of an externally opening injection valve, such as that known from U.S. Pat. No. 4,958,771 or that proposed in German Patent Application DE-P 196 01 019.5 can also be used together with the new magnetic circuit design. Spherical valve closing bodies and perforated spray disks are also conceivable in such valve assemblies.

The injection valve is operated electromagnetically in a known way. The electromagnetic circuit with magnet coil 1, core 2, pole part 13 and armature 19 serves for axial movement of valve needle 20 and thus for opening a restoring spring 33 arranged inside sleeve 10 against spring pressure or for closing the injection valve. Armature 19 is connected to the end of valve needle 20 facing away from valve closing section 28, e.g., by a weld, and it is aligned with core 2. Guide opening 30 of valve seat body 26 serves to guide valve needle 20 during its axial movement with armature 19 along longitudinal valve axis 8. Armature 19 is guided in the precision-manufactured nonmagnetic connecting piece 4 during the axial movement. As shown at the left of FIG. 1, a one-piece version may also be provided as an alternative to the separate design of pole part 13 and bottom housing part 18 described here; with said one-piece version, a narrow peripheral web 35 extends from pole part 13 in the axial direction as a transition to housing part 18, and all the sections together (pole part 13, sleeve-like web 35, bottom housing part 18) form a ferritic part. Similarly, the internal bordering face of web 35 then serves as the guide for armature 19.

An adjusting sleeve 38 is inserted, pressed or screwed into an internal flow bore 37 in sleeve 10 which runs concentric with longitudinal valve axis 8 and serves to supply fuel in the direction of valve seat face 29. Adjusting sleeve 38 serves to adjust the initial tension of restoring spring 33 which is in contact with adjusting sleeve 38 and is in turn supported with its opposite end on a shoulder 39 of armature 19 attached to valve needle 20. One or more annular or bore-like flow channels 40 are provided in armature 19, through which the fuel can flow from flow bore 37 into through-hole 24. As an alternative, polished surfaces on valve needle 20 are also conceivable, so that flow channels 40 are no longer necessary in armature 19. A fuel filter 42 extends into the flow bore 37 of sleeve 10 at the inlet end to filter out substances from the fuel that could cause blockage or damage to the injection valve due to their size. Fuel filter 42 is secured by pressing, for example, in housing part 14.

The stroke of valve needle 20 is determined by valve seat body 26 and pole part 13. One end position of valve needle 20 when magnet coil 1 is not energized is determined by the contact of valve closing section 28 with valve seat face 29 of valve seat body 26, while the other end position of valve needle 20 when magnet coil 1 is energized is determined by the contact of armature 19 with pole part 13. The surfaces of the parts in this area of contact may be chrome-plated, for example.

The electric contacting of magnet coil 1 and thus its energization are accomplished over contact elements 43 which are provided with a plastic spray coating 45 also outside of the actual coil body 3 made of plastic. The plastic spray coating may also extend over other parts (e.g., housing parts 14 and 18) of the fuel injection valve. An electric connecting cable 44 which supplies current to magnet coil 1 leads out of plastic spray coating 45. FIG. 1 shows an especially advantageous embodiment of core 2. Although core 2 is tubular here, it does not have a constant outside diameter. Only in the area of plastic spray coating 45 does core 2 have a constant outside diameter over its entire axial extent. Outside of plastic spray coating 45, core 2 is provided with a collar 46 facing radially outward and extending over magnet coil 1 so that it covers it partially. Plastic spray coating 45 thus projects through a groove in collar 46. Since core 2 is made of a material such as a power composite material that reduces eddy currents, this design is especially appropriate to achieve a very effective magnetic circuit.

The design of th e magnetic circuit according to this invention is explained in detail below. Ferritic soft iron, for example, is an ideal material (from a magnetic standpoint) for core 2. However, this material also has disadvantages. First, the material has very good electric conductivity, which means that eddy currents occur to a great extent; these are a disadvantage and are to be minimized according to this invention. Second, such a soft iron is extremely difficult to machine. Therefore, soft iron is hardly used at all for magnetic circuits today, especially for core 2 of fuel injection valves, but instead a ferritic chromium steel, e.g., a 13% Cr steel is usually used; although its magnetic properties are not as good, it can be handled well.

Starting from this known material for magnetic circuits, the development of eddy currents which are to be minimized is explained briefly. If the magnetic flux density changes in a part carrying magnetic flux (due to electric power supplied to magnet coil 1), then voltages which result in eddy currents (Maxwell's $2^{nd}$ law) are induced perpendicular to the direction of flow in conducting path loops comprising all or part of the flux field. The eddy currents always work against their originating cause (Lenz's rule). In concrete terms, they weaken the effective magnetic field by creating an opposing field. Due to these eddy currents, a large portion of the electric energy supplied is not converted to magnetic energy in the desired manner but instead is converted into thermal energy, which cannot be utilized. Therefore, the goal is to create a magnetic circuit that minimizes eddy currents.

It has been found that soft magnetic powder composites have an especially low tendency to develop eddy currents. For this reason, such a material is used for selected parts of the magnetic circuit carrying magnetic flux, with core 2 being especially suitable for being made of such a powder composite. Calculations have shown that the highest eddy current density occurs precisely in the internal part, i.e., in core 2 of the magnetic circuit, so this is where an eddy-current-minimizing material can be used especially effectively. In combination with ferritic housing part 14 and ferritic pole part 13, this is thus a hybrid magnetic circuit. A powder composite is especially suitable for core 2. This material may be, for example, commercial pure iron powder in a plastic matrix. The iron powder has very small particles, with the individual iron particles being coated with a very thin, electrically insulating layer of phosphate. The powder is also provided with, for example, 0.5 wt % polymer additive (e.g., polyamide, phenolic resin, etc.) which acts as electric insulation and binds the particles. Due to the high electric resistance between the powder particles of such a "baked" composite material from powder metallurgy, hardly any eddy currents can develop there. In addition to the advantageous reduction in eddy currents, there are also other advantages of using a powder composite, such as inexpensive manufacture, easy handling and precision machining (e.g., producing an internal press fit for longitudinal opening 7 in core 2) and good adhesive properties. However, it is especially advantageous that the magnetic properties are comparable to those of known magnetic circuit materials despite the reduced tendency to eddy currents.

Designing selected parts of the volume of the internal pole of the magnetic circuit, specifically core 2, with a material having a low eddy current shortens the switching times of the valve (pickup time, closing time) in comparison with traditional magnetic circuits of the same geometry, in an advantageous manner without any mentionable reduction in the maximum force level of the magnetic circuit. The mechanical properties of the powder composites (relatively great brittleness, relatively low strength) have previously made their use in fuel injection valves seem inappropriate (especially for use with gasoline), because their stability in fuels cannot be guaranteed completely. Valve function could be impaired by particles released from the composite when permanently exposed to fuel. Therefore, encapsulation of the powder composite with sleeve 10 and pole part 13 is performed according to this invention with a seal to the internal flow path conducting the fuel. Nonmagnetic sleeve 10 is designed with a very thin wall to utilize the good magnetic properties of the composite material to the best extent. The encapsulation and mechanical stress relief of the low-eddy-current material of core 2 by a flux-conducting, ferritic pole part 13 and a nonmagnetic eddy-current-free sleeve 10 prevents wear and destruction of the mechanically sensitive composite material.

FIGS. 2 through 5 show different embodiments of the novel magnetic circuit for fuel injection valves. As explained previously, the diagrams omit the valve assemblies on the spray outlet end because they are not essential to this invention. In these embodiments shown in the following figures, parts that are the same or have the same action as those described for the embodiment in FIG. 1 are labeled with the same notation. Only the parts that have been modified in comparison with the embodiment according to FIG. 1 are described in detail below.

Figure 2:
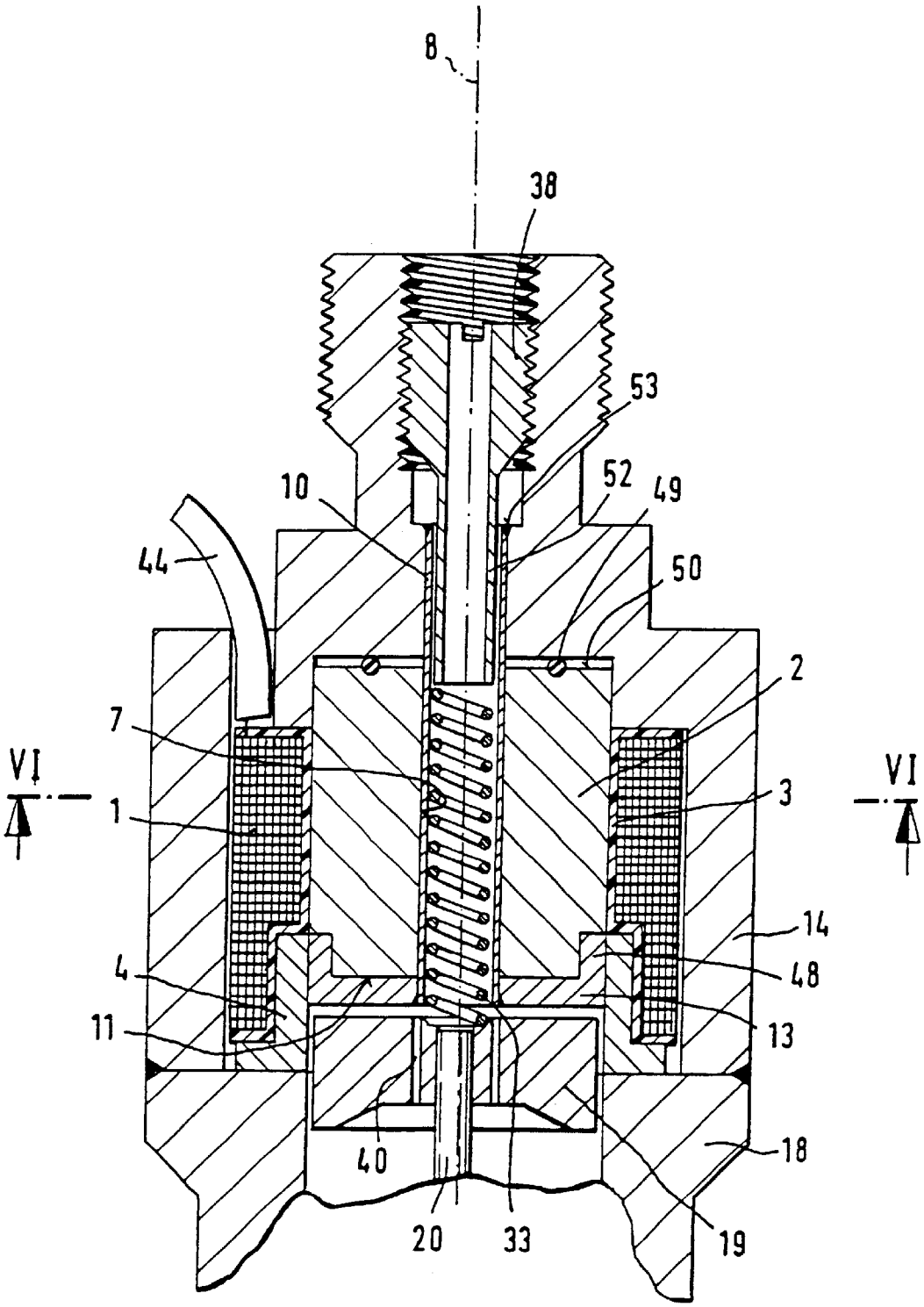
FIG. 2 shows a second embodiment of a magnetic circuit.

FIG. 2 shows partially a fuel injection valve having a tubular core 2 with a mostly constant outside diameter, which thus does not have a collar 46 partially covering magnet coil 1 radially on the outside. Instead, core 2 is designed in steps at its lower end face 11, for example, so that it can be enclosed precisely by pole part 13 which now has an L-shaped profile. Pole part 13 has a peripheral collar 48 standing upward on its radially outer bordering side opposite sleeve 10, said collar being flush axially with connecting piece 4. Thus, core 2 is also partially surrounded on its outer peripheral surface facing magnet coil 1. The fixed connections of sleeve 10 and pole part 13 or pole part 13 and connecting piece 4 are in turn achieved by welding or hard soldering. An elastic ring 49 between a top end face 50 of core 2 and the bottom of housing part 14 has essentially no sealing function, but instead it presses the powder composite material of core 2 in the direction of pole part 13, for example. Adjusting sleeve 38 is inserted into housing part 14 by means of a screw connection or by caulking, for example, and it presses with an elongated sleeve section 52, which tapers toward the downstream end, against restoring spring 33. Sleeve 10 is shortened here in comparison with the embodiment shown in FIG. 1. Its axial length ranges from a housing shoulder 53 of longitudinal opening 7 close to the top end face 50 of core 2 to the downstream bordering face of pole part 13.

Figure 3:
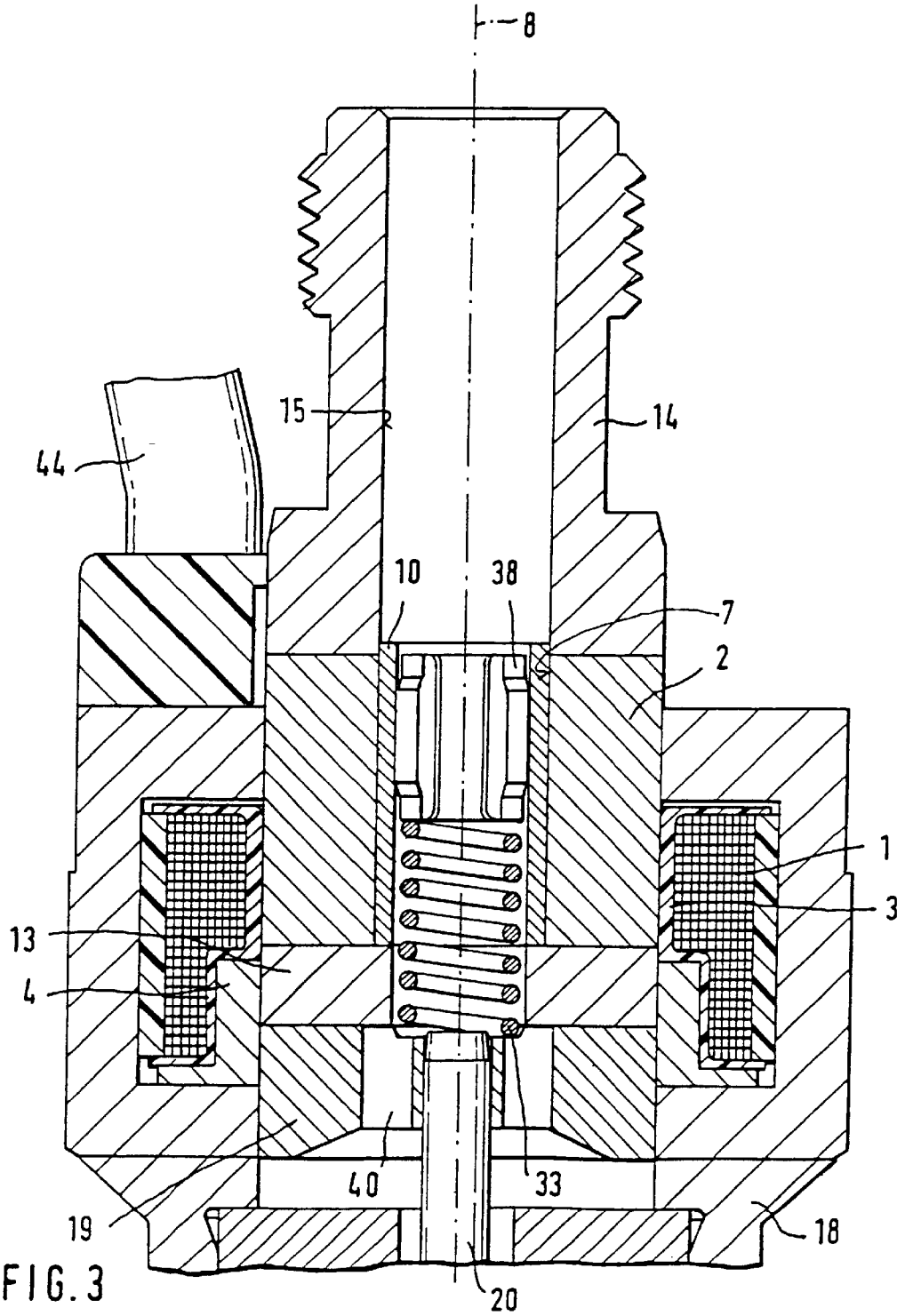
FIG. 3 shows a third embodiment of a magnetic circuit.

FIG. 3 shows a partial view of a fuel injection valve having only a very short sleeve 10 which has a slightly greater axial length than core 2, which is designed as an annulus with a constant inside diameter and a constant outside diameter. Sleeve 10 stands only on pole part 13 with out overlapping, which does not permit an optimum tight connection.

Figure 4:
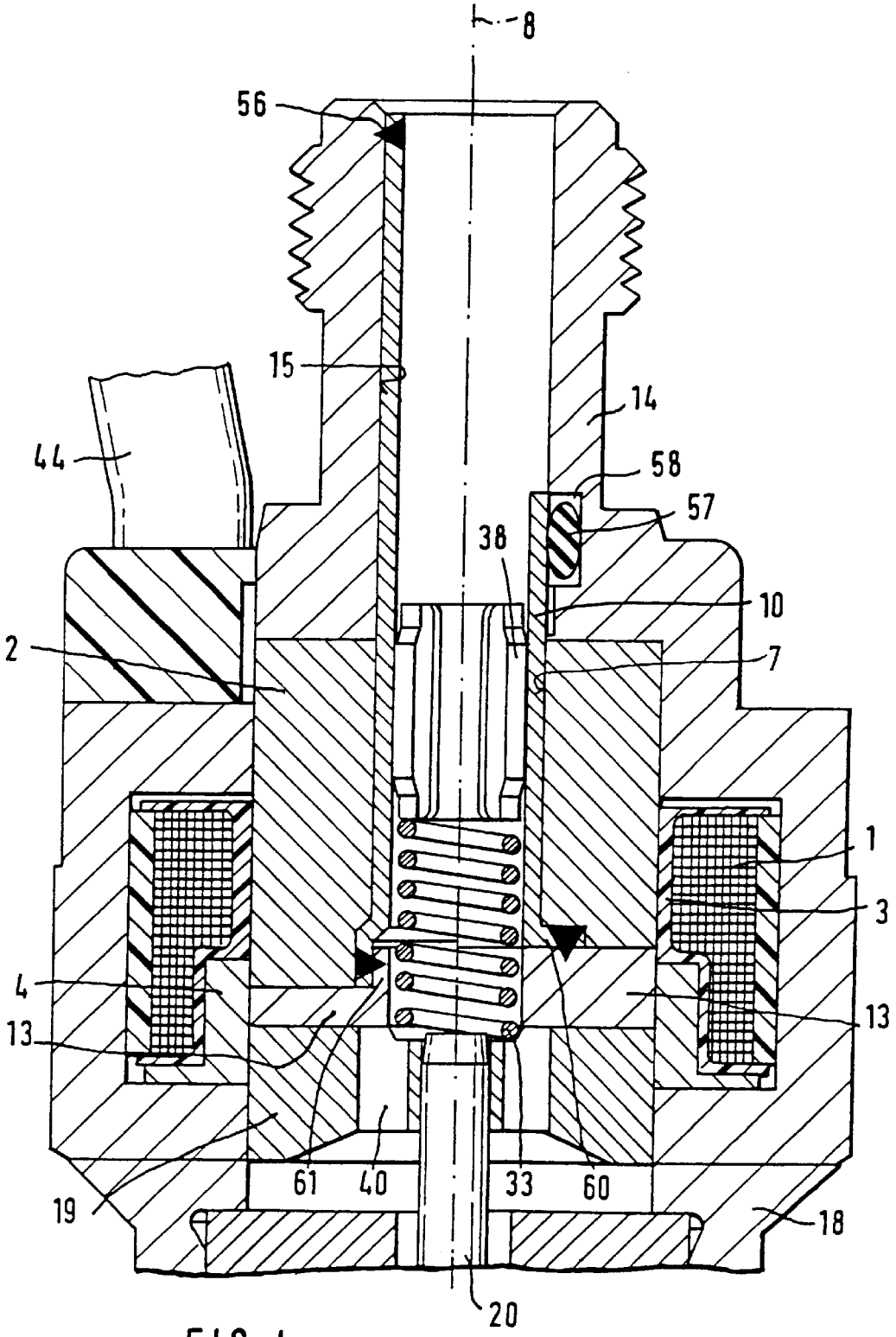
FIG. 4 shows four sealing options and connection techniques for a magnetic circuit.

Four different embodiments of sleeve 10 and sealing options and connection techniques are summarized in FIG. 4. If sleeve 10 is designed with a greater length, e.g., if it extends to the inlet end of the injection valve, one possibility is a fixed connection of sleeve 10 in longitudinal opening 7 of housing part 14 by a weld 56 close to the end of the injection valve. If sleeve 10 is designed shorter, a seal between sleeve 10 and housing part 14 may be provided in the form of a gasket 57 which is inserted above magnet coil 1 in an annular groove 58 in longitudinal opening 7. As alternatives to the small area of contact between sleeve 10 and pole part 13 shown in FIG. 3, two possibilities of a secure connection of the two parts are shown in FIG. 4. Angled areas 60 and 61 on sleeve 10 and on pole part 13 result in overlapping with the other part, thus permitting a simpler method of secure attachment. Area 60, extending, for example, perpendicularly outward at the lower end of sleeve 10 engages partially beneath core 2 at its lower end face 11. On the other hand, pole part 13 facing sleeve 10 may also have a thin-walled area 61 standing upward, which engages with sleeve 10, which is curved slightly outward in this area and thus ensures the desired overlapping. In both cases, a fixed and tight connection can be achieved very easily by welding or soldering.

Figure 5:
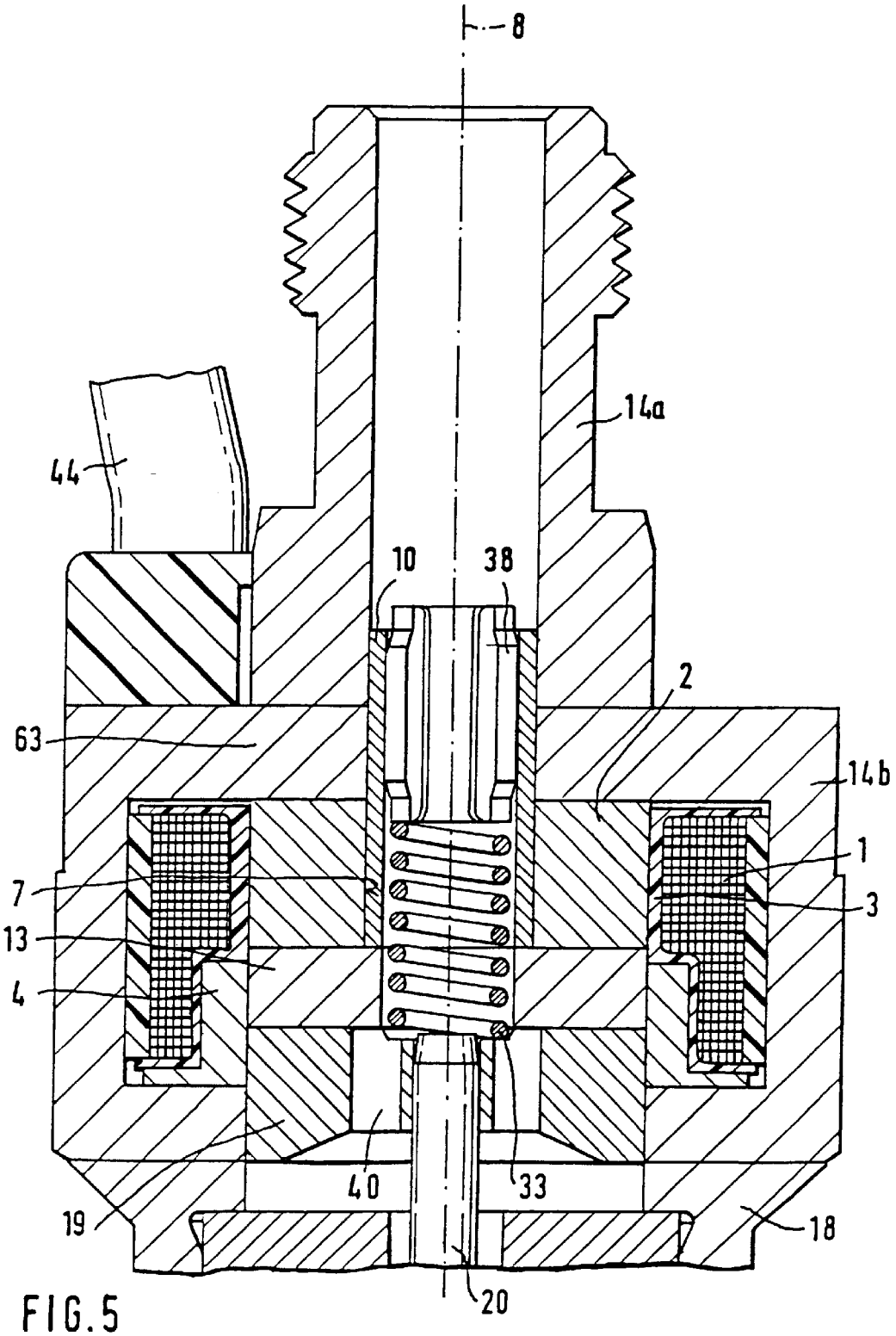
FIG. 5 shows a fourth embodiment of a magnetic circuit.

FIG. 5 shows a magnetic circuit with a shortened core 2. Housing part 14 is designed in two parts, with a first housings part 14*a* largely forming a fuel inlet connection and a second housing part 14*b* forming a magnet housing. Housing part 14*b* has a cover section 63 covering magnet coil 1 and also running over core 2 to sleeve 10 and thus sealing core 2 at the top.

Figure 6:
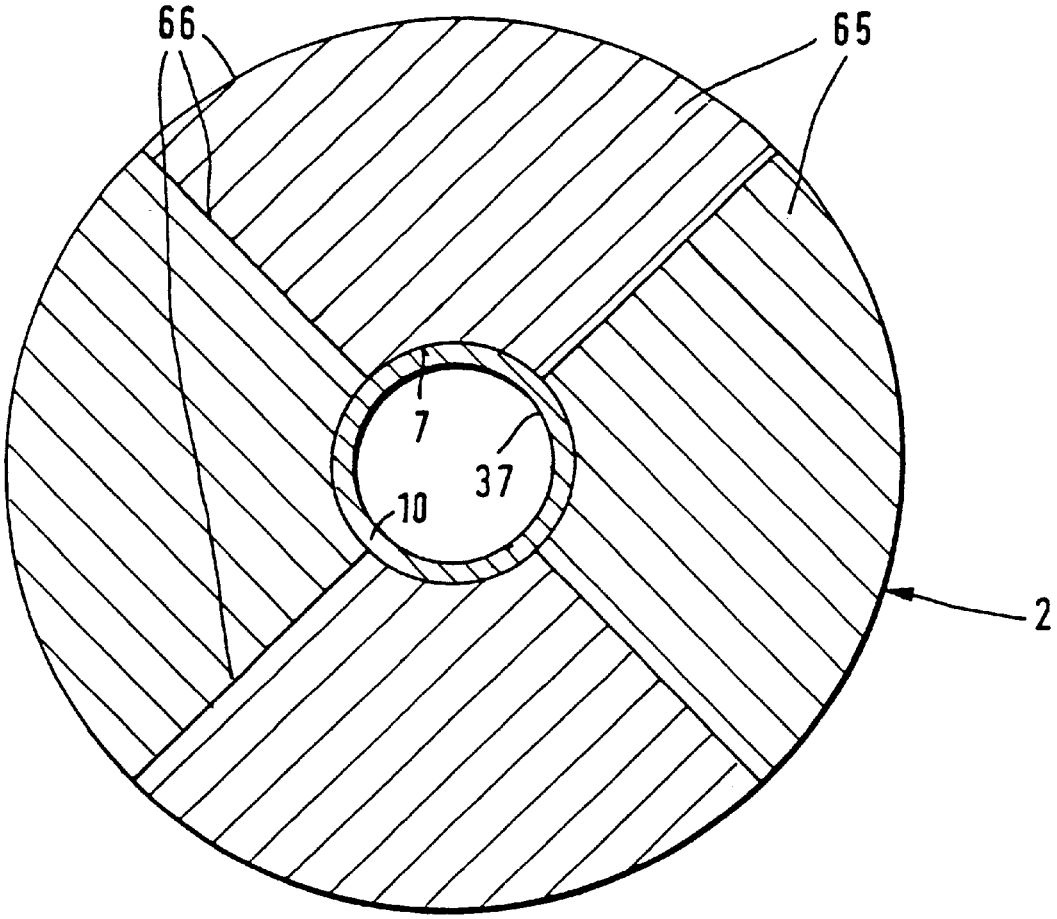
FIG. 6 shows a section through a core along line VI—VI in FIG. 2 which is composed of several sectors.

FIG. 6 shows a section through core 2 along line VI—VI in FIG. 2. However, this sectional diagram already shows an alternative embodiment. This is not a powder composite material in the sense described above as the material for core 2, but instead it is a pure ferritic material. In this embodiment, core 2 is formed by several, e.g., four, sectors 65 which, when assembled, yield a complete annulus. The condition for achieving the positive effect of minimizing the eddy current is that core 2 must be made of at least two parts, but six, eight or ten sectors 65 would also be conceivable. In all these embodiments, the ratio of the circumference to the area of core 2 is increased in an advantageous manner by the multiple sectors 65 which are electrically insulated from one another.

With core 2 composed of sectors 65 (sectored core), sectors 65 having a lower magnetic resistance in comparison with the materials described above are inserted into the magnetic circuit within magnet coil 1. The individual sectors 65 are provided with an electrically insulating surface layer 66 (e.g., enameling) with respect to one another and the surrounding parts. Such an arrangement has certain features in common with powder composite core 2 with respect to minimizing eddy currents. Sleeve 10 and pole part 13 are designed to have the least possible effect or weakening effect on the positive influence of the low-eddy-current volume. Measures in this respect include the thinnest possible pole part 13 and a sleeve 10 with a higher magnetic resistance than the materials of sectors 65 or the powder composite, so that no mentionable magnetic flux penetrates into sleeve 10, where it could otherwise induce eddy currents. In addition, the materials of sleeve 10 always have a higher magnetic resistance than the materials of pole part 13.

It should be emphasized that the encapsulation of core 2 need not necessarily be carried out exclusively with solid metallic parts, such as sleeve 10 and pole part 13. Other possibilities of protecting core 2 from being wetted by fuel include thin-walled plastic parts which may form sleeve 10, for example. In addition, at least partial encapsulation of core 2 by applying electrolytic layers or a resin is also conceivable.

What is claimed is:

1. A fuel injection valve for a fuel injection system of an internal combustion engine, comprising:

a magnetic coil;

a core forming an internal pole, being at least partially surrounded by the magnetic coil, having an internal longitudinal opening, and being composed of a soft magnetic powder composite material;

an armature; and an arrangement tightly sealing the core with respect to a fuel flow path to prevent a wetting of the core by fuel.

2. The fuel injection valve according to claim 1, wherein the fuel injection valve directly injects the fuel into a combustion chamber of the internal combustion engine.

3. The fuel injection valve according to claim 1, wherein the soft magnetic powder composite material of the core includes an iron powder having a polymer additive.

4. The fuel injection valve according to claim 3, wherein the iron powder includes individual iron particles directly coated with an electrically insulating layer.

5. The fuel injection valve according to claim 3, wherein the polymer additive has approximately a 0.5% weight.

6. The fuel injection valve according to claim 1, further comprising:

a sleeve completely extending through the internal longitudinal opening of the core, the sleeve encapsulating the core on an inside portion of the core, the sleeve having an internal flow bore bordering the fuel flow path.

7. The fuel injection valve according to claim 1, wherein the arrangement includes a pole part that, together with the core, forms an internal pole and seals the core in a direction of the armature, and wherein the core has a lower end face contacting the pole part.

8. The fuel injection valve according to claim 7, wherein the pole part includes a ring disk composed of a ferritic material.

9. The fuel injection valve according to claim 1, further comprising:

a sleeve completely extending through the internal longitudinal opening of the core, the sleeve sealing the core on an inside portion of the core, the sleeve having an internal flow bore bordering the fuel flow path, wherein the arrangement includes a pole part sealing the core in a direction of the armature, and wherein the core has a lower end face contacting the pole part.

10. The fuel injection valve according to claim 9, wherein the sleeve is tightly and fixedly attachable to the pole part by at least one of welding and hard soldering.

11. The fuel injection valve according to claim 9, wherein the sleeve is composed of a first material having a first magnetic resistance, and wherein the pole part is composed of a second material having a second magnetic resistance, the first magnetic resistance being larger than the second magnetic resistance.

12. The fuel injection valve according to claim 7, wherein the core includes a collar radially projecting downward on a projecting side of the collar, the projecting side being opposite to the lower end face, and wherein the collar at least partially covering the magnet coil.

13. The fuel injection valve according to claim 7, wherein the pole part has an L-shaped cross section.

14. The fuel injection valve according to claim 8, further comprising:

a ferritic housing part including the pole part.

15. The fuel injection valve according to claim 6, further comprising:

a housing part being fixedly and tightly attachable to the sleeve by one of welding, soldering and crimping.

16. A fuel injection valve for a fuel injection system of an internal combustion engine, comprising:

a magnetic coil;

a core forming an internal pole, being at least partially surrounded by the magnetic coil, having an internal longitudinal opening, and being composed of a plurality of sectors, the plurality of sectors being composed of a pure ferritic material and forming an annulus, one of the plurality of sectors being insulated from another one of the plurality of sectors;

an armature;

an arrangement tightly sealing the core with respect to a fuel flow path to prevent a wetting of the core by fuel.

17. The fuel injection valve according to claim 16, wherein the fuel injection valve directly injects the fuel into a combustion chamber of the internal combustion engine.

18. The fuel injection valve according to claim 16, further comprising:

a sleeve completely extending through the internal longitudinal opening of the core, the sleeve sealing the core on an inside portion of the core, the sleeve having an internal flow bore bordering the fuel flow path.

19. The fuel injection valve according to claim 18, wherein the sleeve is composed of a stainless austenitic steel.

20. The fuel injection valve according to claim 16, wherein the arrangement includes a pole part encapsulating the core in a direction of the armature, and wherein the core has a lower end face contacting the pole part.

21. The fuel injection valve according to claim 20, wherein the pole part includes a ring disk composed of a ferritic material.

22. The fuel injection valve according to claim 16, further comprising:

a sleeve completely extending through the internal longitudinal opening of the core, the sleeve sealing the core on an inside portion of the core, the sleeve having an internal flow bore bordering the fuel flow path, wherein the arrangement includes a pole part sealing the core in a direction of the armature, and wherein the core has a lower end face contacting the pole part.

23. The fuel injection valve according to claim 22, wherein the sleeve is tightly and fixedly attachable to the pole part by at least one of welding and hard soldering.

24. The fuel injection valve according to claim 22, wherein the sleeve is composed of a first material having a first magnetic resistance, and wherein the pole part is composed of a second material having a second magnetic resistance, the first magnetic resistance being larger than the second magnetic resistance.

25. The fuel injection valve according to claim 20, wherein the core includes a collar radially projecting downward on a projecting side of the collar, the projecting side being opposite to the lower end face, and wherein the collar at least partially covering the magnet coil.

26. The fuel injection valve according to claim 20, wherein the pole part has an L-shaped cross section.

27. The fuel injection valve according to claim 21, further comprising:

a ferritic housing part including the pole part.

28. The fuel injection valve according to claim 18, further comprising:

a housing part being fixedly and tightly attachable to the sleeve by one of welding, soldering and crimping.

29. A fuel injection valve for a fuel injection system of an internal combustion engine, comprising:

a magnetic coil;

a core forming an internal pole, being at least partially surrounded by the magnetic coil, having an internal longitudinal opening, and being composed of a soft magnetic powder composite material;

an armature; and an arrangement tightly sealing the core with respect to a fuel flow path to prevent a wetting of the core by fuel, wherein:

the soft magnetic powder composite material of the core includes an iron powder having a polymer additive, the iron powder includes individual iron particles directly coated with an electrically insulating layer, and the electrically insulating layer includes a phosphate layer.

30. A fuel injection valve for a fuel injection system of an internal combustion engine, comprising:

a magnetic coil;

a core forming an internal pole, being at least partially surrounded by the magnetic coil, having an internal longitudinal opening, and being composed of a soft magnetic powder composite material;

an armature;

an arrangement tightly sealing the core with respect to a fuel flow path to prevent a wetting of the core by fuel; and a sleeve completely extending through the internal longitudinal opening of the core, the sleeve encapsulating the core on an inside portion of the core, the sleeve having an internal flow bore bordering the fuel flow path, wherein:

the sleeve is composed of a stainless austenitic steel.

* * * * *